US007695250B2

(12) United States Patent
Johnson et al.

(10) Patent No.: US 7,695,250 B2
(45) Date of Patent: Apr. 13, 2010

(54) DUAL PUMP ASSEMBLY

(75) Inventors: Kent Johnson, Bowie, MD (US); John C. Schultz, Saline, MI (US); Csilla B. Ujvary, Westland, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 733 days.

(21) Appl. No.: 11/265,776

(22) Filed: Nov. 2, 2005

(65) Prior Publication Data

US 2007/0098567 A1 May 3, 2007

(51) Int. Cl.
*F04B 41/06* (2006.01)

(52) U.S. Cl. ..... 417/2; 417/423.14; 184/6.3

(58) Field of Classification Search ..... 417/216, 417/286, 423.5, 427, 428, 2, 360, 423.14, 417/236, 237, 364; 137/565.33, 112, 613; 184/6.3, 27.2, 104.2; 180/65.2, 65.3, 65.4; 123/497, 508, 196 R, 196 C; 60/428–430, 60/486; 477/3, 4, 5, 6; 475/5
See application file for complete search history.

(56) References Cited

U.S. PATENT DOCUMENTS 2,257,095 A * 9/1941 Gottlieb ..... 417/406
4,177,018 A * 12/1979 Granet ..... 417/338
4,204,811 A * 5/1980 Carter et al. ..... 417/288
4,745,743 A * 5/1988 Boulanger ..... 60/328
5,084,964 A * 2/1992 Cyphers ..... 29/888.02
5,273,411 A * 12/1993 Lipscombe ..... 418/132
5,378,128 A * 1/1995 Yanagisawa ..... 418/9
6,125,799 A * 10/2000 Van Son et al. ..... 123/41.31
6,220,832 B1 * 4/2001 Schob ..... 417/423.5
6,739,305 B2 * 5/2004 Takahara et al. ..... 123/196 R
6,805,647 B2 * 10/2004 Silveri et al. ..... 475/4
2001/0016165 A1 * 8/2001 Shimabukuro et al. ..... 417/2

FOREIGN PATENT DOCUMENTS

DE 102006005553 A1 2/2007

* cited by examiner

*Primary Examiner*—Devon C Kramer
*Assistant Examiner*—Dnyanesh Kasture
(74) *Attorney, Agent, or Firm*—Quinn Law Group, PLLC

(57) ABSTRACT

The apparatus of the present invention provides a compact dual-pump assembly for an automotive transmission. The dual-pump assembly preferably includes a housing having a valve assembly mounted thereto. The valve assembly includes a shuttle valve disposed in fluid communication with a pressure regulating valve. An on-axis pump is mounted to the housing in fluid communication with the shuttle valve and the pressure regulating valve. An off-axis pump in fluid communication with the shuttle valve is mounted to the housing in close proximity to the on-axis pump such that the dual-pump assembly is compact.

19 Claims, 3 Drawing Sheets

DUAL PUMP ASSEMBLY

TECHNICAL FIELD

The present invention is drawn to a dual-pump assembly for a vehicle transmission.

BACKGROUND OF THE INVENTION

Conventional transmission pumps are driven by output from the engine. When a hybrid vehicle is being electrically operated, the engine is off and therefore the conventional transmission pump is not operational. An auxiliary electric pump may therefore be implemented for purposes such as meeting the cooling and lubrication needs of a hybrid vehicle transmission when the engine is off. There is, however, limited space available within the hybrid vehicle such that a compact design for the transmission pumps would be desirable.

SUMMARY OF THE INVENTION

An apparatus for a compact dual-pump assembly is provided. More precisely, a housing is adapted to accommodate a primary or on-axis pump and an auxiliary or off-axis pump in a compact manner. The housing preferably includes a plurality of integral fluid transfer channels that replace more conventional connections formed with external tubes or hoses. The integral channels reduce cost associated with the manufacture and assembly of the hoses, and improve the reliability of the apparatus by eliminating failure modes attributable to hose leaks. The dual-pump assembly of the present invention additionally facilitates testing and installation of the primary and auxiliary pumps as the dual-pump subsystem can be pre-assembled and pre-tested as a sub-assembly prior to installation into a transmission.

The dual-pump assembly of the present invention preferably includes a housing having a valve assembly mounted thereto. The valve assembly preferably includes a shuttle valve disposed in fluid communication with a pressure regulating valve. An on-axis pump is mounted to the housing in fluid communication with the shuttle valve and the pressure regulating valve. An off-axis pump in fluid communication with the shuttle valve is mounted to the housing in close proximity to the on-axis pump such that the dual-pump assembly is more compact.

According to one aspect of the invention, the dual-pump assembly includes a plurality of fluid transfer channels defined by the housing and the valve body to facilitate the transfer of fluid between the on-axis pump, the off-axis pump, the shuttle valve and the pressure regulating valve.

According to another aspect of the invention, one or more of the fluid transfer channels is integrally cast into the housing.

According to yet another aspect of the invention, one or more of the fluid transfer channels is integrally cast into the valve body.

According to still another aspect of the invention, the housing is composed of die cast aluminum.

According to a further aspect of the invention, the housing is composed of cast iron.

The above features and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
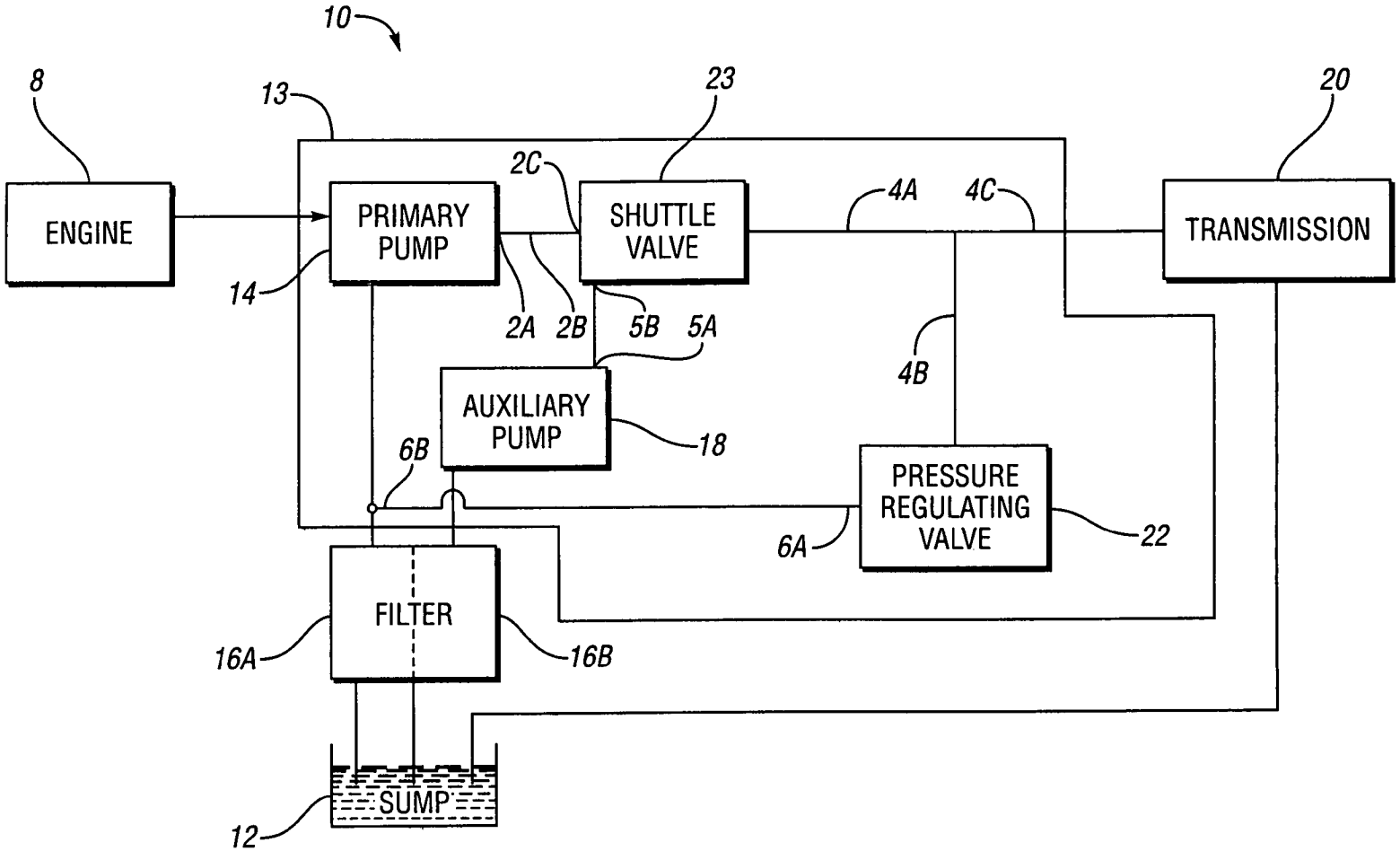
FIG. 1 is a schematic diagram of a portion of a hydraulic system incorporating the present invention.

Referring to the drawings wherein like characters represent the same or corresponding parts through the several views, there is shown in FIG. 1 a schematic representation of a transmission fluid distribution system 10. The fluid distribution system 10 includes a sump or reservoir 12 preferably containing hydraulic fluid, a dual-pump assembly 13, one or more filters such as the filters 16A, 16B, and a transmission 20.

According to a preferred embodiment, the dual-pump assembly 13 includes a housing 25 (shown in FIG. 2), a first, primary or on-axis pump 14, a second, auxiliary or off-axis pump 18, a pressure regulating valve 22, a shuttle valve 23, and a plurality of fluid transfer channels such as the channels 2A-2C, 4A-4C, 5A-5B, and 6A-6B.

The primary pump 14 draws hydraulic fluid from the reservoir 12 through the filter 16A. The auxiliary pump 18 draws hydraulic fluid from the reservoir 12 through the filter 16B. A control module (not shown) selects which of the pumps 14, 18 is active based on, for example, vehicle speed, pressure requirements, cooling requirements, operational status of vehicle components, etc. The pumps 14, 18 deliver pressurized hydraulic fluid to a transmission 20. The shuttle valve 23 combines the outputs 2A, 5A of pumps 14, 18, respectively, and delivers the hydraulic fluid to the transmission 20 and/or the pressure regulator valve 22. The maximum pressure output to the transmission 20 is limited by the pressure regulator valve 22 which delivers excess pump flow back to the inlet of the primary pump 14 through bypass channels 6A-6B. According to a preferred embodiment of the present invention, the hydraulic fluid first satisfies the transmission pressure requirements, including any oil requirements for clutches, a torque converter or starting device, lubrication, and cooling, and thereafter the excess fluid is returned to the inlet of the primary pump 14.

Fluid communication between the primary pump 14 and the shuttle valve 23 is established by channels 2A-C. Fluid communication between the auxiliary pump 18 and the shuttle valve 23 is established by channels 5A-B. Fluid communication between the pressure regulating valve 22, the shuttle valve 23, and the transmission 20 is established by channels 4A-4C. According to a preferred embodiment, one or more of the channels 2A-2B, 4A-4C, 5A-B, and 6A-6B are integrally cast as will be described in detail hereinafter. Advantageously, the integrally cast channels replace conventional fluid connections established by external tubes or hoses such that the dual-pump assembly 13 is composed of fewer, more compact components, and is easier to assemble. Additionally, the dual-pump assembly 13 is preferably pre-assembled and pre-tested before it is installed into a transmission as a sub-assembly thereby simplifying installation and improving reliability.

Figure 2:
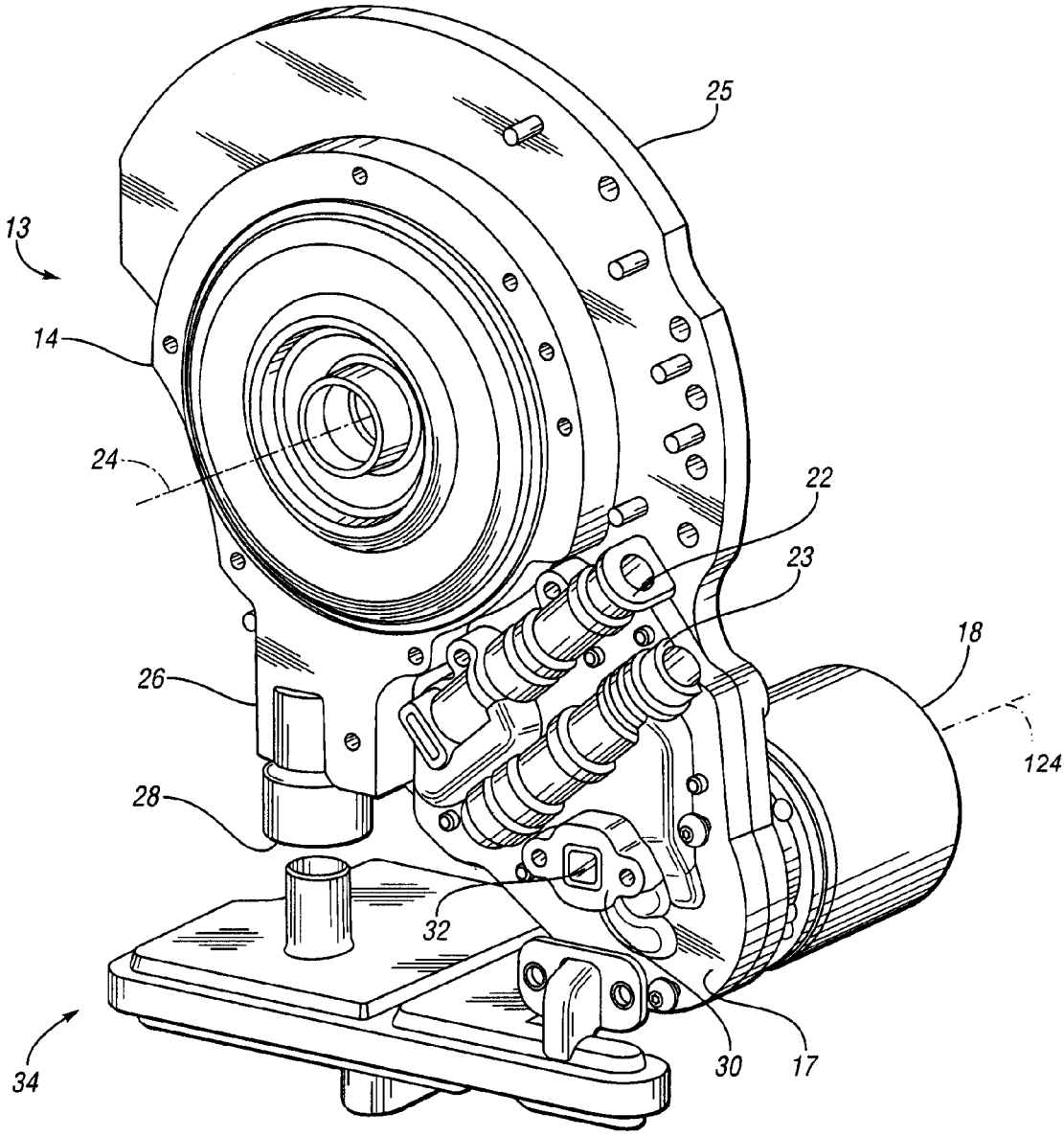
FIG. 2 is a perspective view of a dual-pump assembly of the present invention.

Referring to FIG. 2, the dual-pump assembly 13 is shown assembled and in more detail. The dual-pump assembly 13 includes the primary pump 14 and the auxiliary pump 18 which are mounted to the housing 25. The pressure regulating valve 22 and the shuttle valve 23 are preferably disposed in a valve body 17 which is also mounted to the housing 25. According to a preferred embodiment, a plurality of fluid transfer channels such as the channels 2A-2B, 4A-4C, 5A-5B, and 6A-6B (shown in FIG. 1) are integrally cast into the housing 25 and/or the valve body 17.

The primary pump 14 is an on-axis pump driven by output from the engine 8 (shown in FIG. 1). As will be appreciated by one skilled in the art, the pump 14 is "on-axis" because it has a centerline 24 that is concentric with the input axis of the transmission 20 (shown in FIG. 1). The primary pump 14 is preferably driven by output from the engine 8 when the engine 8 is running. The primary pump 14 includes a pump body 26 configured to define a generally cylindrical inlet bore 28.

As will be appreciated by one skilled in the art, the first pump 14 is "on-axis" because it has a centerline, i.e., a center axis, 24 that is concentric with the input axis 24 of the transmission 20 (shown in FIG. 1), i.e., the center axis 24 of the first pump 14 is coextensive with the center axis 24 of an input shaft (not shown) of the transmission 20.

The auxiliary pump 18 is an off-axis pump that is preferably electrically driven, however, the pump 18 may alternatively be driven by any presently known device adapted for such purpose.

The second pump 18 is "off-axis" because its centerline, i.e., a central axis, 124 is not concentric with the input axis 24 of the transmission 20 (shown in FIG. 1), i.e., the central axis 124 of the second pump 18 is different from the center axis 24 of the input shaft (not shown) of the transmission 20. The auxiliary pump 18 includes a mounting surface 30 defining an inlet aperture 32 that is generally perpendicular to the inlet bore 28 of the primary pump 14.

The housing 25 advantageously retains the primary pump 14, the auxiliary pump 18, and the valve body 17 in sufficiently close proximity to each other such that the dual-pump assembly 13 is more compact. The compact design of the dual-pump assembly 13 is particularly advantageous for applications such as hybrid vehicles wherein there is limited available space. Additionally, the positioning of the components in close proximity to each other allows shorter fluid connections therebetween which minimizes line losses associated with the transfer of fluid and thereby improves the efficiency of the dual-pump assembly 13. As is known in the art, "line losses" are frictional losses incurred when transferring fluid through a line such as a channel. As friction is a function of surface area, a longer channel generally has a greater line loss than a similarly constructed shorter channel.

The housing 25 retains the primary pump 14 and the auxiliary pump 18 such that the inlet bore 28 of the primary pump 14 and the inlet aperture 32 of the auxiliary pump 18 positioned at a predefined location relative to each other. The positioning of the inlet bore 28 and inlet aperture 32 relative to each other facilitates the attachment of a filter assembly 34 that, according to a preferred embodiment, is attached in the manner described in commonly assigned U.S. Provisional Application 60/651,165, filed Feb. 9, 2005, which is hereby incorporated by reference in its entirety.

According to a preferred embodiment, the dual-pump assembly 13 is pre-assembled as shown in FIG. 2 and is tested prior to installation in a transmission. Installation of the dual pump assembly 13 into a transmission as a pre-tested subassembly improves reliability, is ergonomically advantageous, and reduces overall installation time as compared to that required for the installation of separate components.

Figure 3:
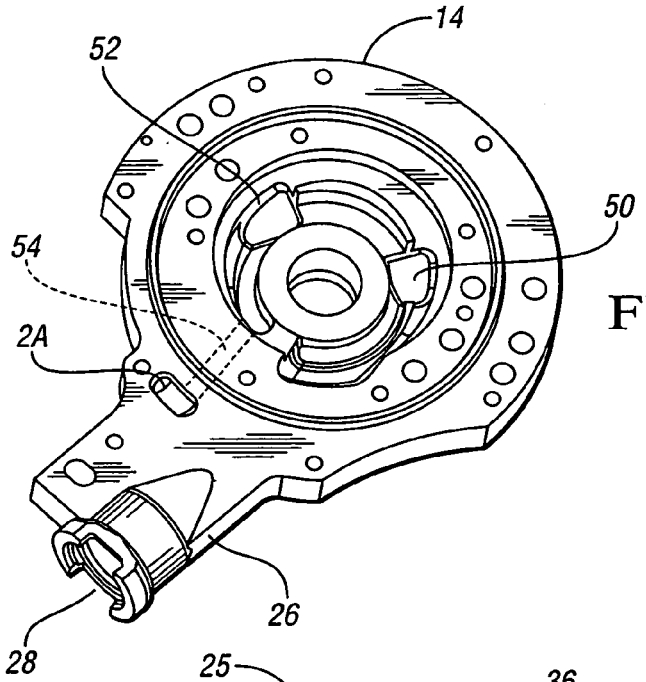
FIG. 3 is a detailed perspective view of a primary pump portion of the dual-pump assembly of FIG. 2.

Referring to FIG. 3, the primary pump 14 is shown in more detail. The primary pump defines an inlet port 50, a discharge port 52 and the discharge passage 2A. The discharge port 52 and the discharge passage 2A are coupled via an internal transfer channel 54 shown with dashed lines. The internal transfer channel 54 is disposed within the primary pump body 26 and may be formed, for example, with sand core technology. As is known in the art, a "sand core" is casting process wherein sand is placed into the mold in a predetermined configuration to form a channel in a molten material, and the sand is removed after the molten material solidifies by shaking the component. The primary pump 14 is configured to transfer fluid through the inlet bore 28, into the inlet port 50, to the discharge port 52, through the internal transfer channel 54, and out the discharge passage 2A. A sand core can also be used to create a similar internal transfer channel which couples the inlet bore 28 to the inlet port 50. Those skilled in the art will recognize that an internal channel could alternatively be produced using aluminum die casting "slide" manufacturing methods. A "slide" is a retractable extension of a die-casting die which can be utilized to create core-like passages without the need for expendable material such as the sand used for sand cores. Those skilled in the art will also recognize that material removal techniques such as milling or drilling, and "plugs" to fill in any unwanted resultant extensions of the machined passages, could alternatively be utilized in any combination with the other described methods to produce internal channels in any chosen material for the dual pump assembly 13.

Figure 4:
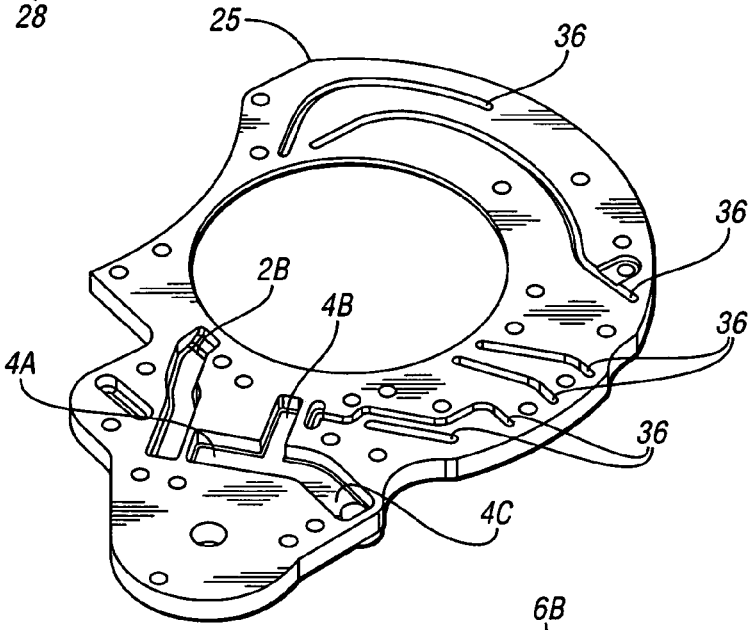
FIG. 4 is a detailed perspective view of a housing of the dual-pump assembly of FIG. 2.

Referring to FIG. 4, the housing 25 is shown in more detail. The housing 25 defines a plurality of integral transfer channels such as the channels 2B, 4A-4C, and 36 that are adapted to facilitate the transfer of pressurized hydraulic fluid in a manner that does not require conventional hoses or tubes. Channel 2B forms a portion of the fluid connection between the primary pump 14 (shown in FIG. 3) and the shuttle valve 23 (shown in FIG. 2). When the pump 14 is assembled to the housing 25, the channel 2B is in fluid communication with the channel 2A (shown in FIG. 3) such that pressurized hydraulic fluid from the pump 14 is transferable into the channel 2B. Channels 4A-4C form a fluid connection between the shuttle valve 23 (shown in FIG. 2), the pressure regulating valve 22 (shown in FIG. 2), and the transmission 20 (shown in FIG. 1). The channels 36 may be implemented for purposes such as transferring pressurized hydraulic fluid in a compact manner without requiring the use of tubes or hoses to meet other transmission oil transfer requirements (not shown), whether or not they are related directly to the primary function of the dual pump assembly 13.

Figure 5:
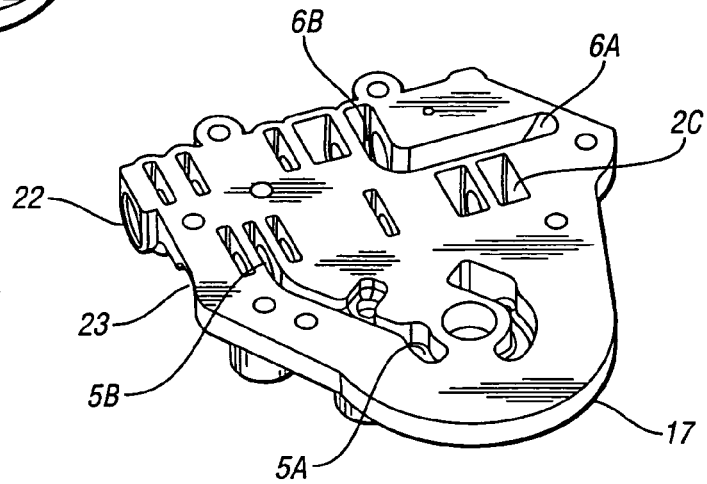
FIG. 5 is a detailed perspective view of a valve body of the dual-pump assembly of FIG. 2.

Referring to FIG. 5, the valve body 17 is shown in more detail. The valve body 17 defines a plurality of integral transfer channels such as the channels 2C, 5A-5B, and 6A-6B that are adapted to facilitate the transfer of pressurized hydraulic fluid in a manner that does not require conventional hoses or tubes. Channel 2C forms a portion of the fluid connection between the primary pump 14 (shown in FIG. 3) and the shuttle valve 23. When the valve body 17 is assembled to the housing 25, the channel 2C is in fluid communication with the channel 2B (shown in FIG. 4). Channels 5A-5B form a fluid connection between the auxiliary pump 18 (shown in FIG. 2) and the shuttle valve 23. Channels 6A-6B form a fluid connection between the pressure regulating valve 22 back to the primary pump 14. The channels 6A-6B are the bypass channels adapted to transfer excess pump flow from the pressure regulating valve 22 back to the inlet of the primary pump 14. According to a preferred embodiment, a spacer plate (not shown) is disposed between the housing 25 (shown in FIG. 4) and the valve body 17 to control fluid transfer therebetween.

The channels 2A-2B, 4A-C, 5A-5B, and 6A-6B shown in FIGS. 3-5 are preferably die cast during the fabrication of the housing 25 and the valve body 17 such that additional machining is not required. Die casting the channels advantageously reduces the time and expense associated with producing more labor intensive machined channels. Additionally, die casting the channels preserves the skin of the composite material such that porosity is not exposed and cross channel leakage is prevented.

According to a preferred embodiment, the pump housing 25 and/or the valve body 17 are composed of die cast aluminum. The preferred composition facilitates processing and represents a substantial weight savings. According to an alternate embodiment, the pump housing 25 and/or the valve body 17 are composed of cast iron. The alternate construction could reduce the number of components required to create the dual pump assembly 13 via the use of sand cores to create internal channels including bends in a compact manner.

While the best modes for carrying out the invention have been described in detail, those familiar with the art to which this invention relates will recognize various alternative designs and embodiments for practicing the invention within the scope of the appended claims.

The invention claimed is:

1. A dual-pump assembly configured for delivering fluid to a transmission, the dual-pump assembly comprising:

a housing configured for installation into the transmission;

a valve body mounted to said housing and including a shuttle valve and a pressure regulating valve;

a first pump mounted to said housing and configured for being driven by output from a running engine;

wherein said shuttle valve is mounted between said first pump and said pressure regulating valve so that fluid output from said first pump may pass through said shuttle valve before the fluid is delivered to said pressure regulating valve;

wherein a center axis of said first pump is coextensive with the center axis of an input shaft of the transmission; and a second pump mounted to said housing and configured for being driven by a device other than the running engine;

wherein a central axis of said second pump is different from the center axis of the input shaft of the transmission.

2. The dual-pump assembly of claim 1, further comprising a plurality of fluid transfer channels defined by said housing and said valve body, wherein one or more of said plurality of fluid transfer channels is configured to transfer fluid between said first pump, said second pump, said shuttle valve, and said pressure regulating valve.

3. The dual-pump assembly of claim 2, wherein one or more of said plurality of fluid transfer channels is configured to transfer fluid to the transmission.

4. The dual-pump assembly of claim 3, wherein one or more of said plurality of fluid transfer channels is integrally cast into said housing.

5. The dual pump assembly of claim 3, wherein one or more of said plurality of fluid transfer channels is integrally cast into said valve body.

6. The dual pump assembly of claim 3, wherein said housing is composed of die cast aluminum.

7. The dual pump assembly of claim 3, wherein said housing is composed of cast iron.

8. A dual-pump assembly configured for delivering fluid to a transmission, the dual-pump assembly comprising:

a housing configured for installation into the transmission;

a shuttle valve mounted to said housing;

a pressure regulating valve mounted to said housing and in fluid communication with said shuttle valve;

a first pump mounted to said housing and in fluid communication with said shuttle valve and said pressure regulating valve; and a second pump mounted to said housing and in fluid communication with said shuttle valve;

wherein said shuttle valve is mounted between said first pump and said pressure regulating valve so that fluid output from said first pump may pass through said shuttle valve before the fluid is delivered to said pressure regulating valve.

9. The dual pump assembly of claim 8, further comprising a valve body mounted to said housing.

10. The dual-pump assembly of claim 9, further comprising a plurality of fluid transfer channels defined by said housing and said valve body, wherein one or more of said plurality of fluid transfer channels is configured to transfer fluid between said first pump, said second pump, said shuttle valve, and said pressure regulating valve.

11. The dual-pump assembly of claim 10, wherein one or more of said plurality of fluid transfer channels is integrally cast into said housing.

12. The dual pump assembly of claim 11, wherein one or more of said plurality of fluid transfer channels is integrally cast into said valve body.

13. The dual pump assembly of claim 12, wherein said housing is composed of die cast aluminum.

14. The dual pump assembly of claim 12, wherein said housing is composed of cast iron.

15. A dual-pump assembly configured for delivering fluid to a transmission, the dual-pump assembly comprising:

a housing configured for installation into the transmission;

a valve body mounted to said housing, said valve body including a shuttle valve in fluid communication with a pressure regulating valve;

a first pump mounted to said housing and in fluid communication with said shuttle valve and said pressure regulating valve;

a second pump mounted to said housing and in fluid communication with said shuttle valve; and a plurality of fluid transfer channels defined by said housing and said valve body, wherein one or more of said plurality of fluid transfer channels is configured to transfer fluid between said first pump, said second pump, said shuttle valve, and said pressure regulating valve;

wherein said shuttle valve is mounted between said first pump and said pressure regulating valve so that fluid output from said first pump may pass through said shuttle valve before the fluid is delivered to said pressure regulating valve;

wherein fluid output from said first pump and fluid output from said second pump may combine and pass through said shuttle valve before the fluid is delivered to the transmission.

16. The dual-pump assembly of claim 15, wherein one or more of said plurality of fluid transfer channels is integrally cast into said housing.

17. The dual pump assembly of claim 16, wherein one or more of said plurality of fluid transfer channels is integrally cast into said valve body.

18. The dual pump assembly of claim 17, wherein said housing is composed of die cast aluminum.

19. The dual pump assembly of claim 17, wherein said housing is composed of cast iron.

* * * * *